US008757745B2

(12) United States Patent
Kurasawa

(10) Patent No.: US 8,757,745 B2
(45) Date of Patent: Jun. 24, 2014

(54) PRINTING APPARATUS

(75) Inventor: Kanto Kurasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 365 days.

(21) Appl. No.: 12/631,523

(22) Filed: Dec. 4, 2009

(65) Prior Publication Data

US 2010/0141694 A1 Jun. 10, 2010

(30) Foreign Application Priority Data

Dec. 10, 2008 (JP) ..... 2008-314637

(51) Int. Cl.
*B41J 29/38* (2006.01)

(52) U.S. Cl.
USPC ..... 347/6; 347/84; 347/93

(58) Field of Classification Search
None
See application file for complete search history.

(56) References Cited

U.S. PATENT DOCUMENTS

| | | | | |
|---|---|---|---|---|
| 5,988,782 | A | 11/1999 | Miura et al. | 347/6 |
| 6,336,705 | B1 * | 1/2002 | Torigoe | 347/43 |
| 6,951,382 | B2 * | 10/2005 | Inui et al. | 347/37 |
| 2007/0291076 | A1 | 12/2007 | Seki et al. | 347/37 |

FOREIGN PATENT DOCUMENTS

| | | | |
|---|---|---|---|
| JP | 9-104106 | 4/1997 | |
| JP | 2000-198227 | 7/2000 | |
| JP | 2003311993 | * 11/2003 | B41J 2/175 |
| JP | 2004-050504 | * 2/2004 | B41J 2/01 |
| JP | 2006-192758 | 7/2006 | |
| JP | 2007-160861 | 6/2007 | |
| JP | 2007-331308 | 12/2007 | |

* cited by examiner

*Primary Examiner* — Uyen Chau N Le
*Assistant Examiner* — Chad Smith
(74) *Attorney, Agent, or Firm* — Fitzpatrick, Cella, Harper & Scinto

(57) ABSTRACT

The printing apparatus includes: a print unit to print on a medium using a pigment ink and a dye ink; a stir mechanism capable of stirring at least the pigment ink; and a control unit to perform control to make the duration of the stirring operation executed prior to starting the printing operation longer when the pigment ink is included in the ink to be used in the printing operation than when it is not.

7 Claims, 12 Drawing Sheets

| PRINT MEDIUM | INK TO BE USED |
|---|---|
| GLOSSY MEDIUM | DYE INK |
| OHP SHEET | DYE INK |
| POSTCARD | DYE INK + PIGMENT INK |
| PLAIN PAPER | DYE INK + PIGMENT INK |

FIG.12

PRINTING APPARATUS

BACKGROUND OF THE INVENTION

1. Field of the Invention

The present invention relates to a printing apparatus capable of printing an image using pigment inks and dye inks.

2. Description of the Related Art

Inks used in ink jet printing apparatus are largely classified into two kinds, dye inks and pigment inks. Dye inks are characterized by their production of vivid colors, although they blur easily. Pigment inks do not blur easily and have good water- and light-resistance although they are not good for fine color expression. Considering these characteristics of the inks, a method has been proposed which selectively uses a kind of ink suited to an image to be printed.

For example, as described in U.S. Pat. No. 6,336,705, since characters are printed mostly with a black ink, a pigment ink with a characteristic of not easily blurring is used as a black ink for the printing of characters. Further, since color inks such as cyan, magenta and yellow are often used for printing designs or patterns, dye inks able to produce vivid colors are used for pattern printing. Depending on the image being printed, the black pigment ink and the color dye inks are appropriately switched as described above. This method allows the user of this printing apparatus to produce high-quality printed materials of text documents and patterns without having to become particularly conscious of the kind of ink used.

Further, as described in U.S. Pat. No. 6,951,382, when a pigment ink is left unused for a long period of time, pigment density in the ink may become varied from one location to another. For example, the pigment densities in the upper and lower parts of an ink tank containing the pigment ink may differ, and the use of such an ink tank as is may result in the print density or grayscale level of a printed image differing from that obtained when the pigment is evenly dispersed.

If the ink tank accommodating the pigment ink is left in a static state for a long period, it is necessary to stir the pigment ink thoroughly in the ink tank before the printing operation is resumed. Thorough stirring is effective for producing satisfactory printing results.

If the stirring of the pigment ink is done before the printing operation, the time for ink stirring needs to be added to the time for preparing the printing operation, prolonging the first printout time, the time it takes to start printing a first sheet of print medium.

SUMMARY OF THE INVENTION

The present invention provides a printing apparatus capable of quickly starting a printing operation while maintaining a high print quality by shortening a delay in starting the printing operation caused by the stirring of a pigment ink.

The printing apparatus of this invention that achieves the above objective comprises: a print unit to print on a print medium using a pigment ink and a dye ink, a stir mechanism capable of stirring at least the pigment ink, and a control unit to perform control in a way that makes the stirring operation executed prior to the start of the printing operation longer when the ink used for printing includes the pigment ink than when it does not.

Further features of the present invention will become apparent from the following description of exemplary embodiments (with reference to the attached drawings).

BRIEF DESCRIPTION OF THE DRAWINGS

FIG. 12 is an example of correspondence between the kind of print medium and an ink used in a third embodiment of this invention.

DESCRIPTION OF THE EMBODIMENTS (First Embodiment)

Figure 1:
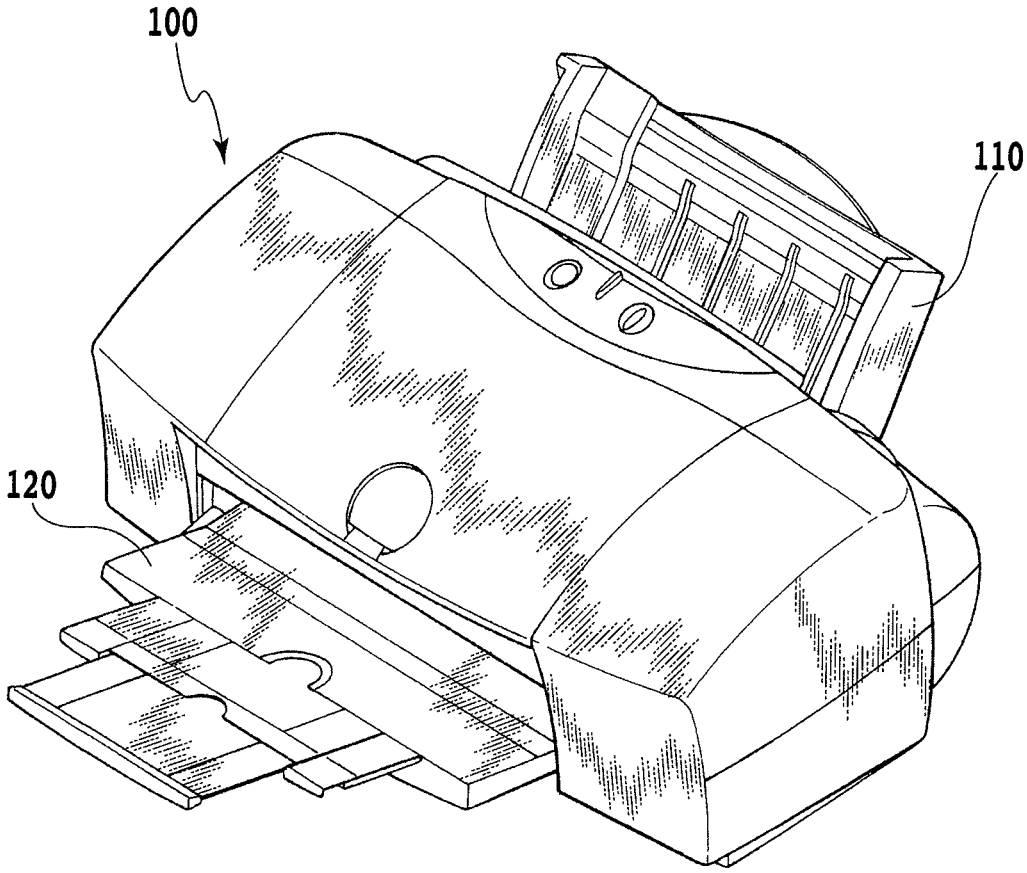
FIG. 1 is an external perspective view of an ink jet printing apparatus in a first embodiment of this invention.
Figure 2:
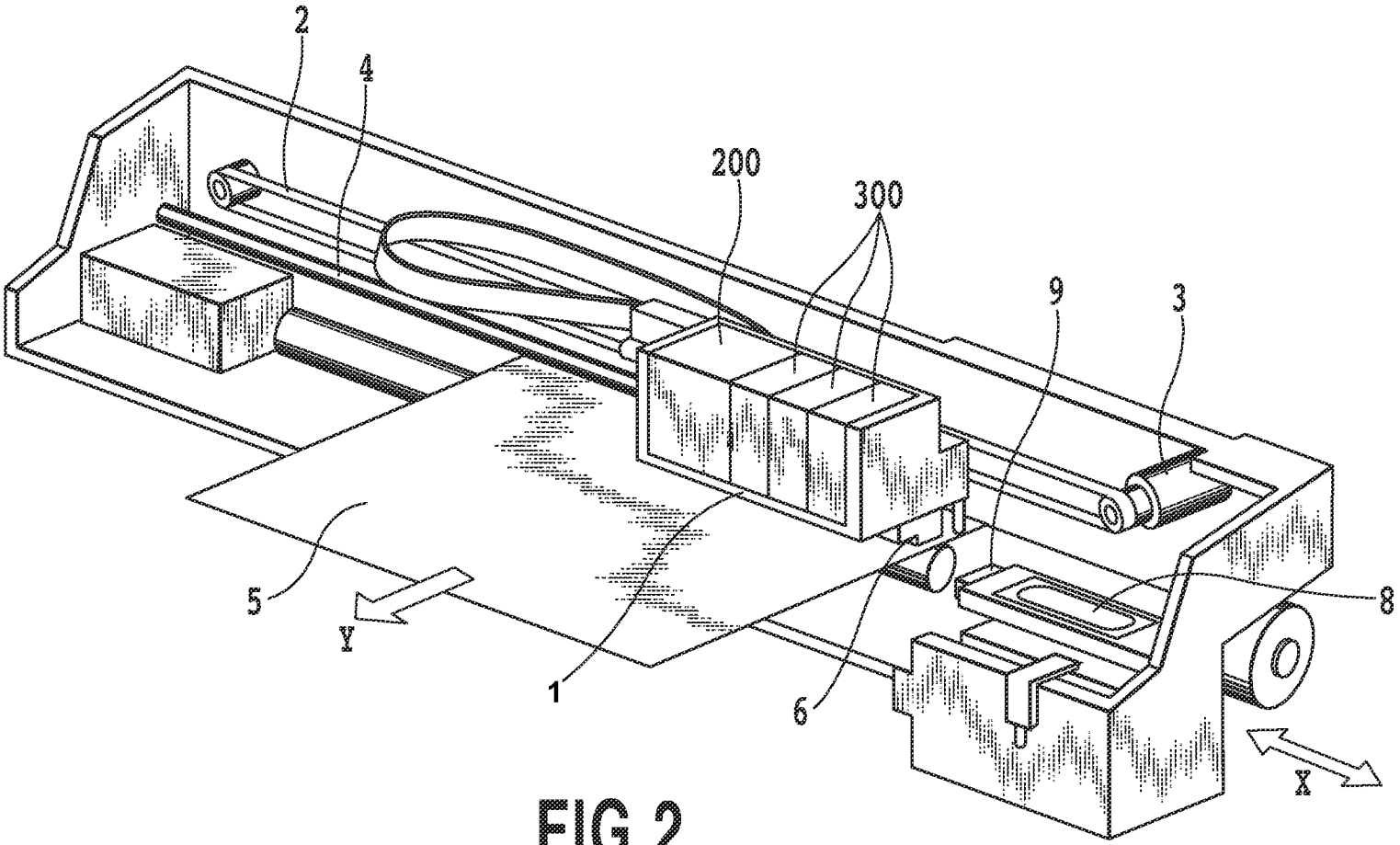
FIG. 2 is a perspective view showing a mechanism inside the body of the ink jet printing apparatus of FIG. 1.

An ink jet printing apparatus can print on a variety of print mediums at high speed and employs a non-impact printing method that produces almost no noise during printing. In a basic construction the ink jet printing apparatus includes, as shown in FIG. 1, an apparatus body 100, a print medium (e.g. paper) feed unit 110 and a discharge tray 120. Inside the apparatus body 100 a printing mechanism is constructed as shown in FIG. 2. An ink jet print head 6 to execute a desired printing on a print medium 5 carried to a print position is detachably mounted on a carriage 1. Also detachably mounted on the carriage 1 are a pigment ink tank 200 containing a pigment ink to be supplied to the print head 6 and a dye ink tank 300 containing dye inks to be supplied to the print head 6. In this case, one pigment ink tank 200 and three dye ink tanks 300 are mounted. The carriage 1 is moved back and forth along a main scan direction indicated by arrow X along a guide shaft 4 by a drive force of a carriage motor 3 transmitted through a timing belt 2. The print medium 5 is fed in a subscan direction of arrow Y crossing the main scan direction (in this case at right angles).

The pigment ink tank 200 and the dye ink tank 300 can be detachably mounted to the print head 6. The print head 6 ejects ink droplets from its ejection openings by using elements to generate ejection energy, such as electrothermal conversion elements (heaters) formed of heat resistor, piezoelectric elements, MEMS elements and electrostatic elements. When the electrothermal conversion elements are used, ink in ink paths communicating with ejection openings is heated by the associated heater to produce a bubble which, as it expands, expels an ink droplet from each ejection opening. The ejection energy generation element, ink path and ejection opening are together called a "nozzle".

In this example, the pigment ink tank 200 contains a pigment black ink (hereinafter called a "pigment K ink"). The dye ink tanks 300 contains a dye cyan ink ("dye C ink"), a dye magenta ink ("dye M ink") and a dye yellow ink ("dye Y ink"). The print head can eject the pigment K ink, dye C ink, dye M ink and dye Y ink from the associated nozzle arrays.

At a home position of the print head 6, a capping device 8 is installed. When the print head 6 moves to the home position, the capping device 8 covers the nozzles of the print head 6 with the cap to prevent evaporation of ink from the nozzles and adherence of viscous ink to the inside of nozzles. The cap is connected with a suction pump (not shown) through a tube, which can introduce a negative pressure into the cap covering the nozzles to suck out from the nozzles the ink not contributing to the image printing and discharge it (suction-based recovery operation). Denoted 9 is a blade that moves relative to the print head 6 to wipe clean an ejection opening-formed face of the print head 6. The ink not contributing to the image printing may also be ejected from the nozzles into the cap (preliminary ejection). A cleaning operation to clean the nozzles and ink paths in the print head 6 may include the suction-based recovery operation, wiping operation and preliminary ejection operation.

In the process of image printing, the printing scan of the print head 6 and the feeding of the print medium 5 are alternated repetitively. During the printing scan the print head 6 ejects ink from its ejection openings according to image data as it moves together with the carriage 1 in the main scan direction. During the feed operation, the print medium 5 is moved forward by a predetermined distance in the subscan direction.

Figure 3:
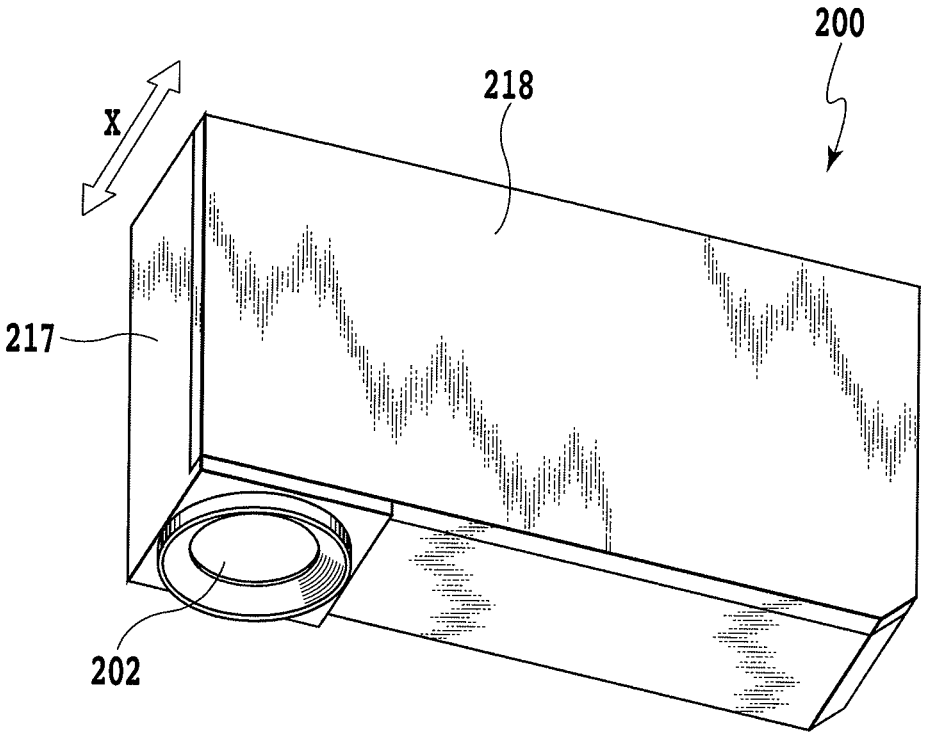
FIG. 3 is a perspective view of a pigment ink tank of FIG. 2.
Figure 4:
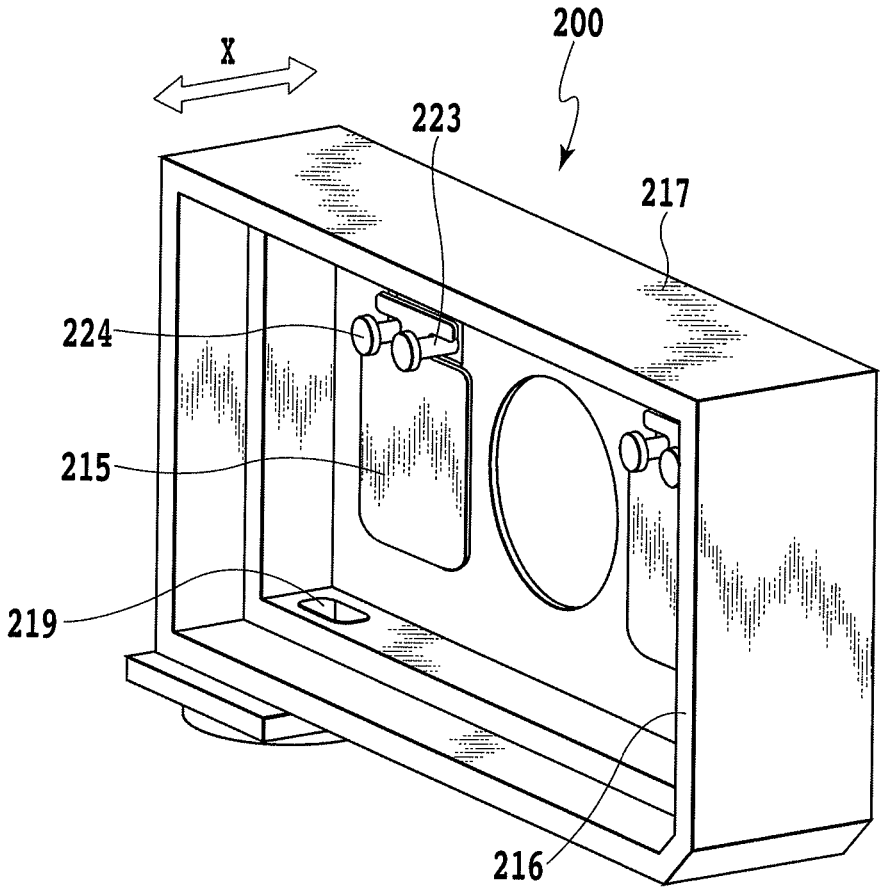
FIG. 4 is a perspective view of an essential portion of the pigment ink tank of FIG. 3 showing its internal construction.
Figure 5:
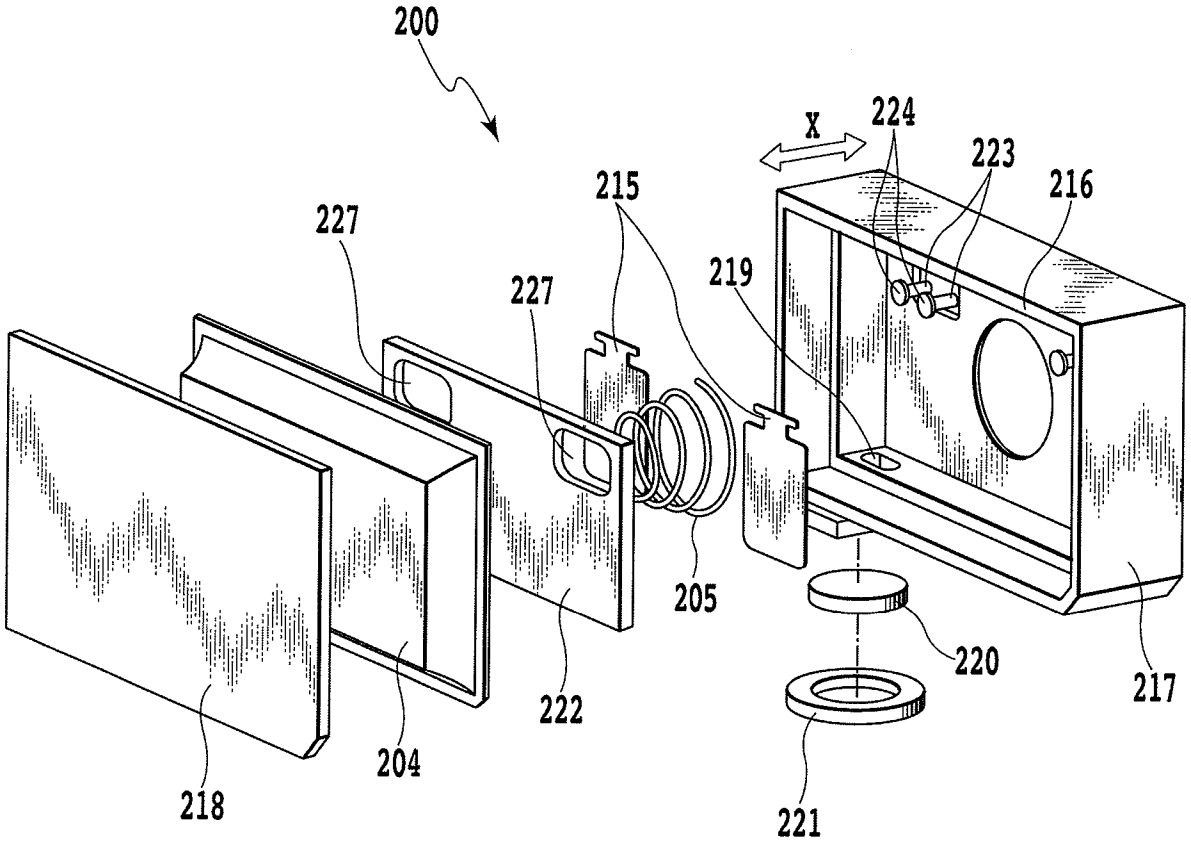
FIG. 5 is an exploded perspective view of the pigment ink tank of FIG. 3.

FIG. 3 is an external perspective view of the pigment ink tank 200, FIG. 4 is a perspective view showing an inner construction of the pigment ink tank 200, and FIG. 5 is an exploded perspective view of the pigment ink tank 200.

The pigment ink tank 200 is a container to accommodate a liquid pigment ink and, as shown in FIG. 3, includes a container body 217 and a cover member 218, both forming an ink chamber therein. The pigment ink tank 200 has formed in its bottom an ink supply port 202 through which to supply ink to the print head 6. Further, as shown in FIG. 5, the pigment ink tank 200 includes a spring member 205, a plate member 222, a flexible film 204, a meniscus forming member 220, a retainer plate 221 and a stir member 215.

A container body 217 may be formed of, for example, polypropylene and, as shown in FIG. 5, has the meniscus forming member 220 installed in the ink supply port 202 at the bottom of the container body 217. On the outer side of the meniscus forming member 220 the retainer plate 221 is attached. The meniscus forming member 220 may be a capillary member formed of a fiber material, such as polypropylene, and having a capillary attraction, or a combination of the capillary member and a filter member.

The filter member may have a penetration dimension of about 15-30 μm and be formed of such materials as stainless material and polypropylene. The meniscus forming member 220 communicates with the interior of the container body 217 through an ink path 219 to form an ink meniscus in a way that blocks infiltration of air bubbles from outside into the ink chamber described later.

An opening peripheral portion 216 of the container body 217 is fused with a peripheral portion of the flexible film 204 to form the ink chamber for accommodating ink between the inner wall of the container body 217 and the flexible film 204. The flexible film 204 may, for example, be a film member (20-100 μm thick) including a polypropylene thin film. The flexible film 204 is biased outwardly by the spring member 205 through the plate member 222 to generate a negative pressure in the ink chamber. The spring member 205 and the plate member 222 are formed of, for instance, stainless material. The opening of the container body 217 is covered with the cover member 218 to protect the flexible film 204 that is outwardly convex. The cover member 218 is provided with an open air communication portion (not shown) so that the inside of the cover member 218 that is separated from the ink chamber by the flexible film 204 is set to an atmospheric pressure.

As the ink in the ink chamber is supplied through the ink supply port 202 to the print head 6 that consumes it, the volume of the ink chamber decreases, accompanied by a shrinkage of the spring member 205 and a deflection of the flexible film 204. The plate member 222 is provided with openings 227 to avoid interference with support members 223 described later. It is therefore possible to consume the ink in the ink chamber until the plate member 222 comes into contact with the inner wall of the container body 217.

The stir member 215 has a supported end held by the support members 223 and an oscillatable end that can be oscillated in the main scan direction of arrow X in which the carriage 1 moves. The stir member 215 is made of a material with a specific gravity heavier than that of ink (e.g., SUS), and during the printing operation and the stirring operation, oscillates by inertia generated by the back and forth motion of the carriage 1 to stir the ink in the ink chamber. The support members 223 have formed at their front end a retainer portion 224 that prevents the stir member 215 from coming off.

Figure 6:
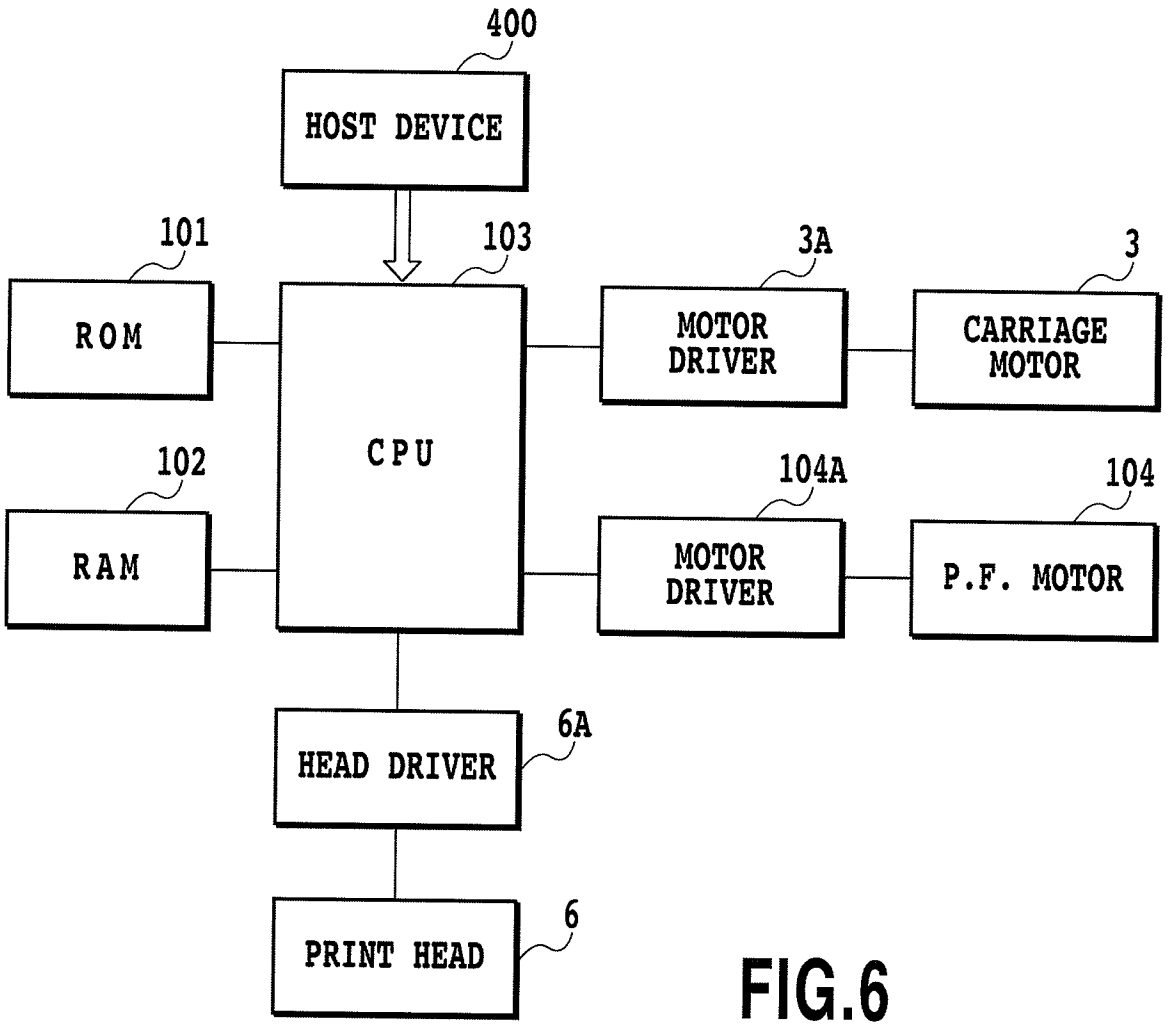
FIG. 6 is a block configuration diagram of the control unit in the ink jet printing apparatus of FIG. 1.

FIG. 6 is an overall block configuration diagram of the control unit of the printing apparatus. A CPU 103 executes control processing with respect to the operation of the printing apparatus (including the control of the stirring operation described later) and data processing. A ROM 101 stores programs containing instructing steps with respect to the control processing, and a RAM 102 is used as a work area in which to execute the processing. Ink ejection from the print head 6 is performed by supplying drive data (image data) for ejection energy generation elements such as electrothermal conversion elements and a drive control signal to a head driver 6A according to image data input from the host device 400. The CPU 103 controls a carriage motor 3, that drives the carriage 1 in the main scan direction, through a motor driver 3A, and also controls a P.F. motor 104, that feeds the paper 5 in the subscan direction, through a motor driver 104A.

The pigment ink can be stirred without ejecting ink from the print head 6, by moving the carriage 1 that mounts the print head 6, the pigment ink tank 200 and the dye ink tanks 300 in the main scan direction. It is noted that during this stirring operation no printing can be done using the print head 6.

With respect to the stirring operation, the pigment ink tank 200, along with the carriage 1 is moved back and forth along the main scan direction a predetermined number of times or for a predetermined period of time, stirring the pigment ink in the pigment ink tank 200. As a result, the pigment in the pigment ink is evenly scattered and the density of the pigment ink made uniform. During the stirring operation, the stir member 215 supported by the support members 223 oscillates assuring a reliable stirring of the pigment ink.

Figure 7:
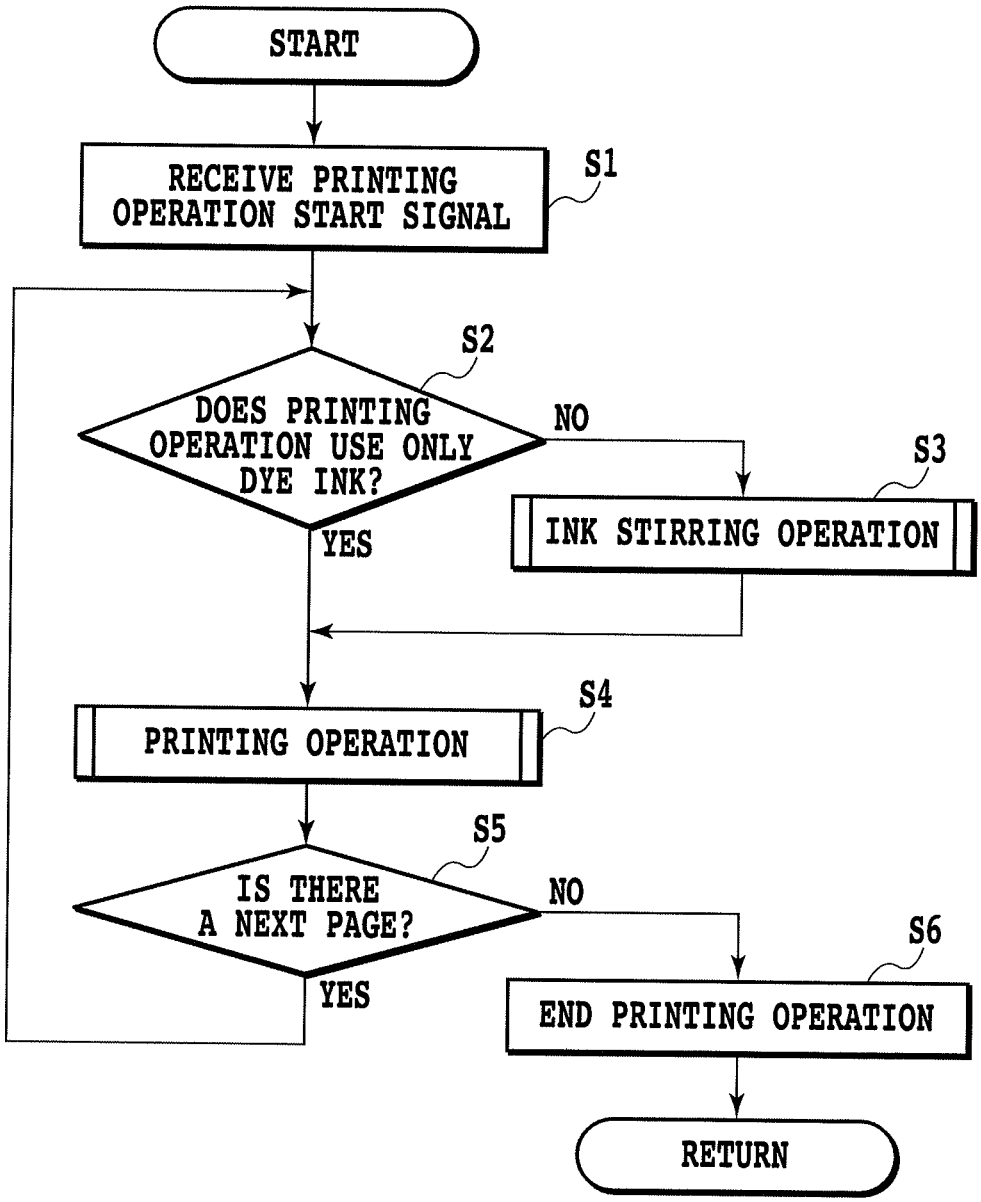
FIG. 7 is a flow chart showing a sequence of operations performed by the ink jet printing apparatus of the first embodiment of this invention.

FIG. 7 is a flow chart showing a sequence of steps executed in the printing operation of this embodiment.

At step S1 the ink jet printing apparatus receives a print signal from an external device (host device) 400 such as a personal computer (PC). At the next step S2, it checks the received print signal to determine the kind of ink to be used in the printing operation. If the result of the check at step S2 finds that the printing operation to be executed is not one that uses only a dye ink, but one that includes a pigment ink as the ink to be used, the printing apparatus at step S3 performs the ink stirring operation a predetermined number of times or for a predetermined period of time. During the stirring operation, the carriage 1 moves back and forth in the main scan direction a predetermined number of times or for a predetermined period, as described above. After the stirring operation is finished, the printing operation is executed at step S4. If, on the other hand, the result of the check at step S2 finds that the printing operation is one that uses only a dye ink and does not include a pigment ink as the ink to be used, the printing apparatus does not execute the ink stirring operation and proceeds to step S4 where it performs the printing operation.

According to this embodiment, the duration of the stirring operation executed prior to the printing operation is set to be longer when a pigment ink is included in the ink used for printing than when it is not. That is, when the printing operation using only a dye ink and not using a pigment ink at all is performed, the ink stirring operation is not executed (i.e., the stirring operation duration is zero) before starting the printing operation. This allows the printing apparatus to immediately start the printing operation without wasting time stirring the pigment ink that is not used in the printing operation. If the printing operation is not one that uses only a dye ink but one that uses at least a pigment ink, the printing apparatus performs the predetermined stirring operation before starting the printing operation. The above ink stirring procedure can make uniform in density the pigment ink to be supplied to the print head 6 for the printing operation, allowing a high quality image to be printed.

At step S2 the kind of ink to be used in the printing operation is determined based on print data, one of the print signals received. For example, when an image including black characters is printed, it is decided according to the print data that the ink to be used for that printing includes at least a pigment K ink that does not easily blur. In this case, the ink stirring operation is executed before the printing operation is started. In this printing operation, the image including black letters will be printed using at least the pigment K ink. In other words, the image including the black letters can be printed using only the pigment K ink, or a combination of the pigment K ink and at least one of dye inks C, M, Y. When an image of patterns covering an entire print area on a page is printed, it is decided according to the print data that the ink to be used for the printing does not include the pigment K ink. In that case, the ink stirring operation is not executed before the printing operation. In the printing operation the image of patterns covering the entire page will be printed using at least one of the dye inks C, M, or Y.

At step S5 it is checked whether there is a next print item (next page) to be printed and, if not, at step S6 the printing operation is ended. If the next print item (next page) exists, the processing returns to step S2.

(Second Embodiment)

The printing operation mechanism in the ink jet printing apparatus may supply ink to the print head through ink paths from a position remote from the print head. A basic construction of the ink jet printing apparatus of this embodiment, as in the case of FIG. 1, includes the apparatus body 100, the print medium feed unit 110 and the discharge tray 120.

Figure 8:
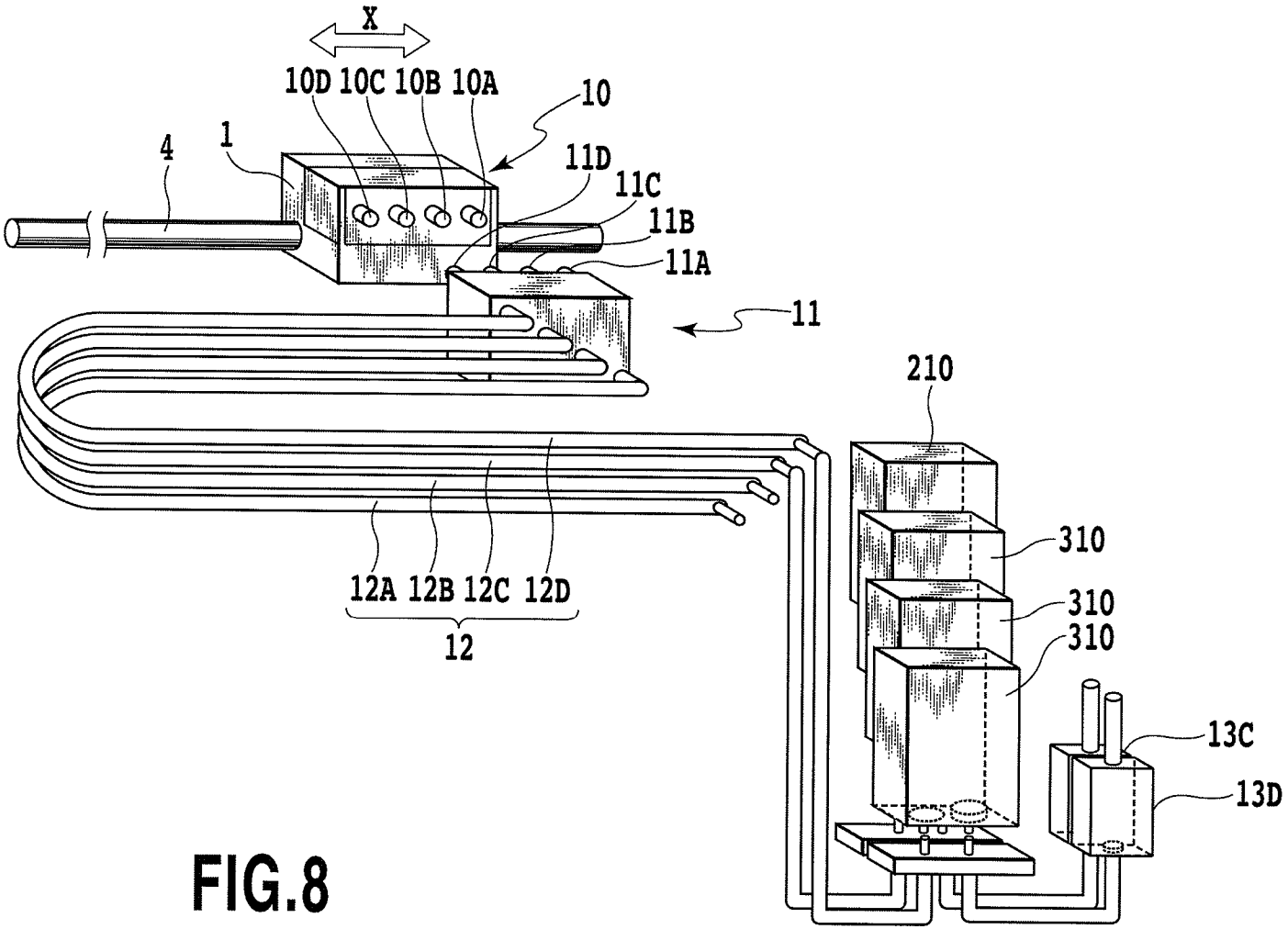
FIG. 8 is a perspective view showing a mechanism inside a second embodiment of the ink jet printing apparatus of this invention.

FIG. 8 is a schematic perspective view of the printing operation mechanism inside the apparatus body 100, with a subtank 10 on the carriage 1 communicating with a pigment ink tank 210 and dye ink tanks 310 through tubes 12. To minimize the load bearing on the carriage 1, to increase the print speed and reduce the size and weight of the printing apparatus, it is effective to reduce the size of the subtank 10 mounted on the carriage 1, as shown in FIG. 8.

That is, the subtank 10 of relatively small capacity is mounted on the carriage 1 to supply ink to the print head 6. The subtank 10 is replenished with ink through the tubes 12 from a pigment ink tank 210 and dye ink tanks 310 of relatively large capacity, fixed at predetermined positions in the apparatus body. A supply joint 11 forms an ink supply path between the subtank 10 and the tubes 12. The supply joint 11 can be connected to the subtank 10 to refill the subtank 10 with ink from the pigment ink tank 210 and dye ink tanks 310 at an optimum time determined by the capacity of the subtank 10 and ink consumption by the print head 6. The supply joint 11 may also be connected at all times with the subtank 10 and form an ink supply path between the subtank 10 and the tubes 12.

In this example, the pigment ink tank 210 contains a pigment black ink (hereinafter referred to as "pigment K ink"). The dye ink tanks 310 contain a dye cyan ink ("dye C ink"), a dye magenta ink ("dye M ink") and a dye yellow ink ("dye Y ink"). The print head can eject the pigment K ink, dye C ink, dye M ink and dye Y ink from their associated nozzle arrays.

With respect to subtank 10, reference numerals 10A, 10B, 10C, and 10D represent inlet portions for pigment K ink, dye C ink, dye M ink and dye Y ink, corresponding to outlet portions 11A, 11B, 11C, 11D of the supply joint 11. The outlet portions 11A, 11B, 11C, 11D are connected through tubes 12A, 12B, 12C, 12D to one pigment ink tank 210 and three dye ink tanks 310. FIG. 8 does not show the connecting portions between the tubes 12A, 12B and the associated ink tanks. The one ink tank 210 and three ink tanks 310 are each connected with respective buffer chambers 13A, 13B, 13C, and 13D. 13A and 13B are not shown in FIG. 8.

Figure 9:
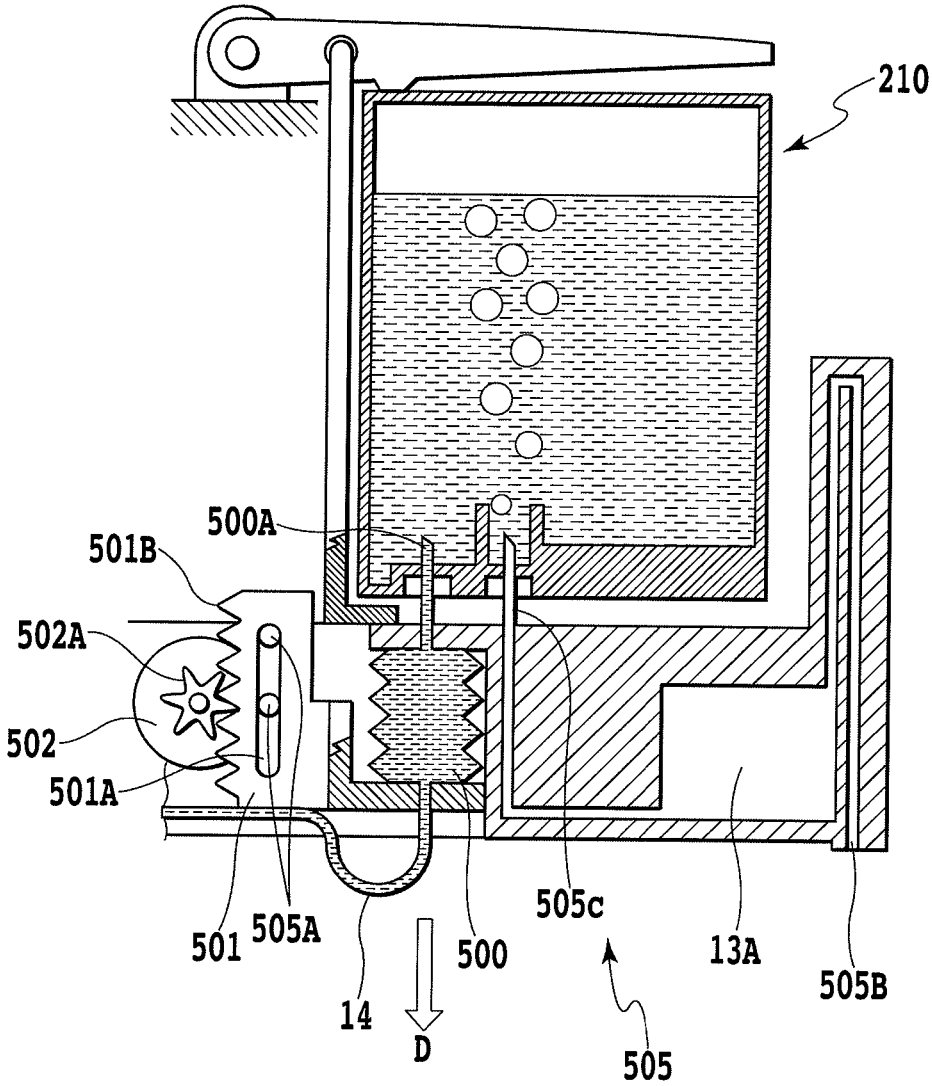
FIG. 9 is a cross-sectional view showing an inner construction of the pigment ink tank of FIG. 8 and a stirring mechanism in a stirring operation using open air.
Figure 10:
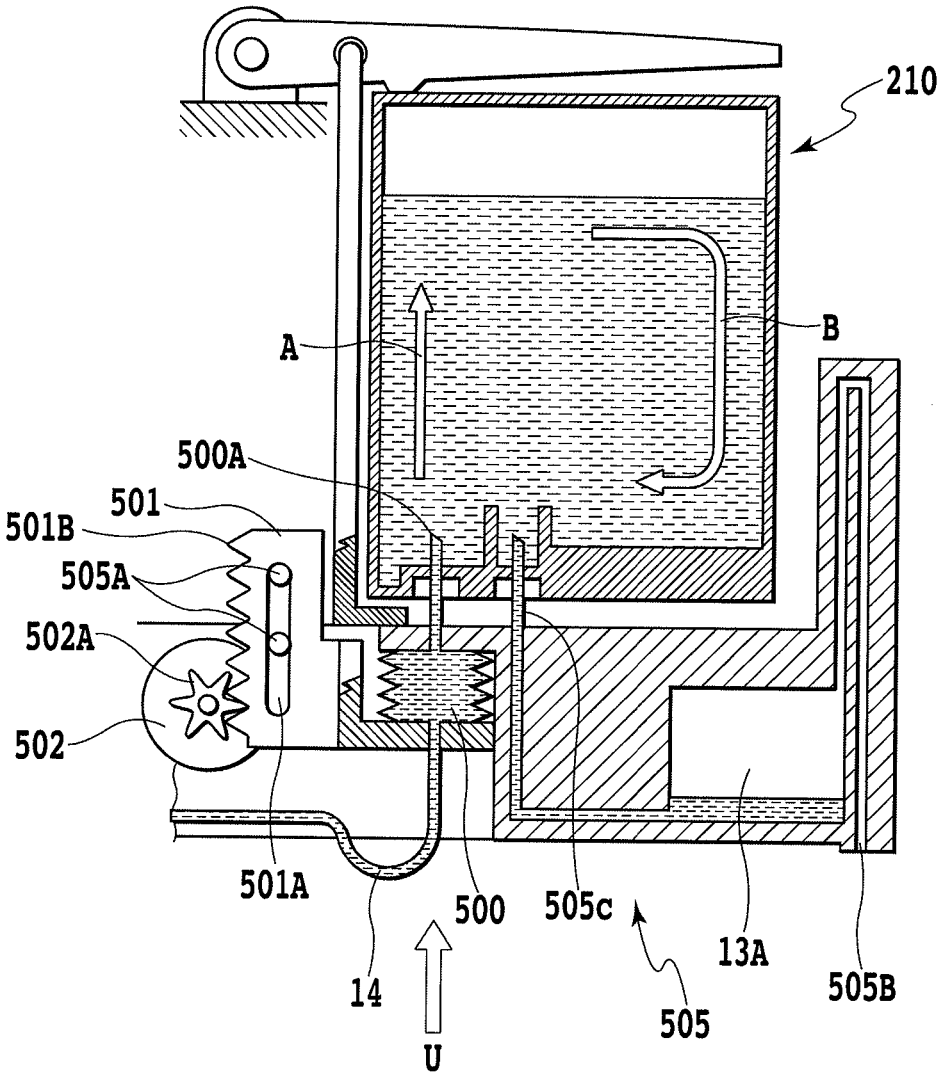
FIG. 10 is a cross-sectional view showing an inner construction of the pigment ink tank of FIG. 8 and a stirring mechanism in a stirring operation using an ink flow.

The pigment ink tank 210 is provided with an ink stirring mechanism, such as shown in FIG. 9 and FIG. 10.

A top surface of a diaphragm 500 making up the stir mechanism is connected with a hollow needle 500A and its bottom surface is connected with the tube 12A through an ink supply path 14. The bottom of the diaphragm 500 is secured to a diaphragm holder 501. At a predetermined position in the printing apparatus is installed a supply base 505, whose engagement shafts 505A are slidably engaged in an engagement slot 501A of the diaphragm holder 501. The diaphragm holder 501 therefore is supported on the supply base 505, and is vertically slidable.

The diaphragm holder 501 has formed at one side a rack portion 501B, with which a pinion gear 502A of a drive motor 502 engages to cause the diaphragm holder 501 to move up or down according to the forward or backward rotation of the drive motor 502.

That is, when the drive motor 502 rotates clockwise, the diaphragm holder 501 lowers in the direction of arrow D as shown in FIG. 9, expanding the diaphragm 500 and increasing its volume. As the volume of the diaphragm 500 increases, air flows into it through an air communication hole 505B and enters the ink tank 210 from an ink needle 505C, at which time air bubbles produced in the ink tank 210 stirs the pigment ink in the tank.

When the drive motor 502 rotates counterclockwise, the diaphragm holder 501 rises in the direction of arrow U, compressing the diaphragm 500 and reducing its volume as shown in FIG. 10. As the volume of the diaphragm 500 decreases, ink within the diaphragm 500 is expelled from the tip of the hollow needle 500A out into the ink tank 210, generating a strong flow of ink in the direction of arrow A in the tank. This in turn produces an ink flow in the direction of arrow B in the ink tank 210, disturbing the pigment ink in the tank. The air that has been introduced into the ink tank 210 by the expanding diaphragm 500 as shown in FIG. 9 can be released to the outside through an air vent not shown.

In this embodiment, the stir mechanism can raise and lower the diaphragm holder 501, independently of the printing operation, to alternately introduce air and ink into the ink tank 210, stirring the ink in the tank 210. More precisely, the ink stirring operation in the ink tank 210 is performed by raising and lowering the diaphragm holder 501 a predetermined number of times or for a predetermined period of time.

This stir mechanism works independently of the operation of the carriage 1 and the print head 6 and therefore can execute the stirring operation simultaneously with the printing operation of the print head 6. The ink stirring mechanism is not limited to a construction using the diaphragm 500 of this embodiment. For example, it may use a screw mechanism that stirs ink in the ink tank by a screw or a circulation mechanism that circulates ink in the ink tank.

Figure 11:
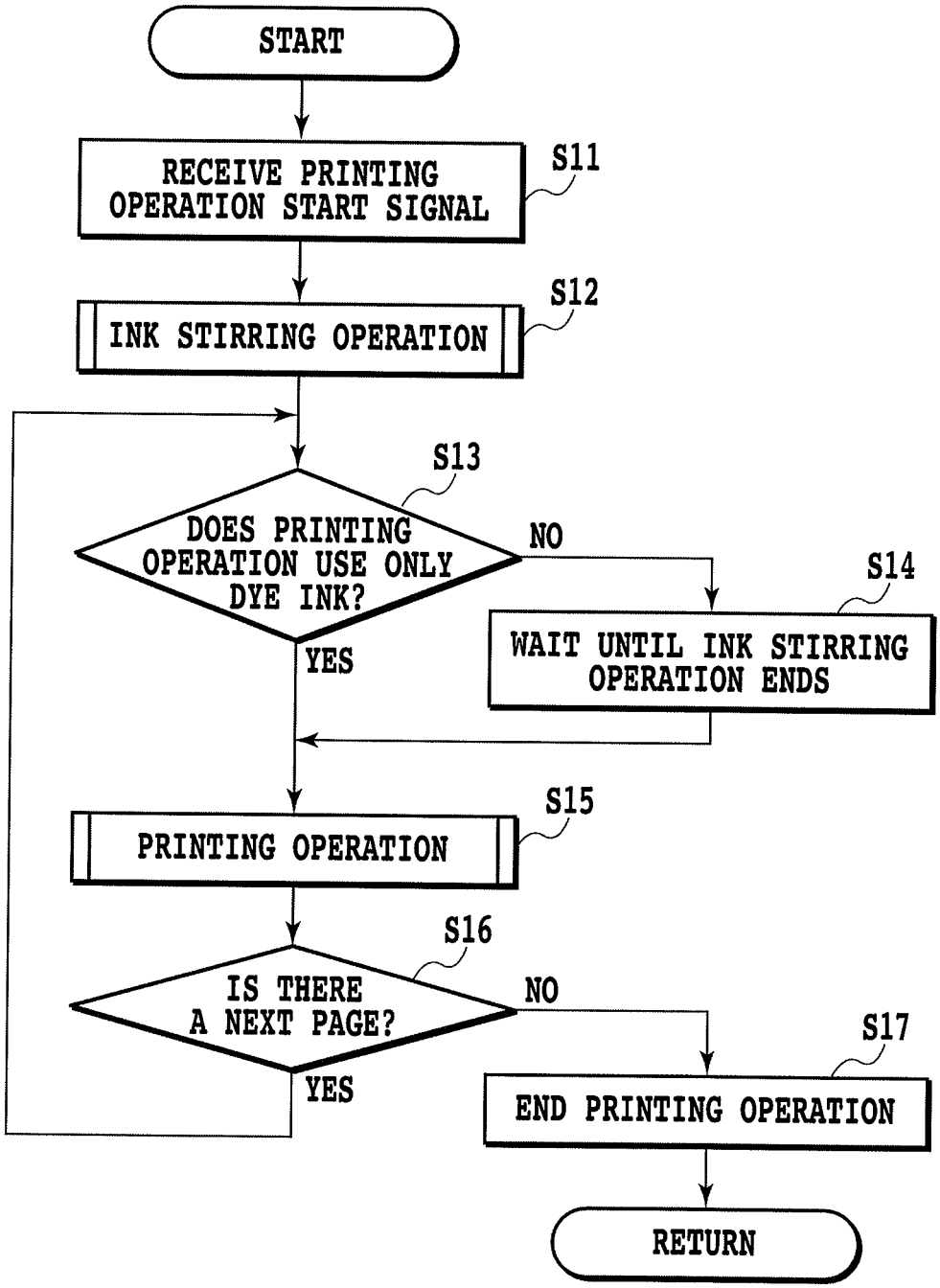
FIG. 11 is a flow chart showing a sequence of operations performed by the ink jet printing apparatus of the second embodiment of this invention.

FIG. 11 is a flow chart showing a sequence of steps executed by the printing operation in the ink jet printing apparatus of this embodiment.

The ink jet printing apparatus at step S11 receives a print signal from an external device (host device) 400 such as personal computer (PC). Next, at step S12 the ink stirring operation is executed a predetermined number of times or for a predetermined period of time. At the next step S13, the printing apparatus checks the print signal received at step S11 to determine the kind of ink to be used in the printing operation. If the result of the check in step S13 finds that the printing operation to be executed is not one that uses only a dye ink, but one that includes a pigment ink as the ink to be used, the printing apparatus waits at step S14 until the ink stirring operation is finished. When the stirring operation is over, the printing apparatus executes the printing operation at step S15. If, on the other hand, the result of the check at step S13 finds that the printing operation is one that uses only a dye ink and does not include a pigment ink as the ink to be used, the printing apparatus executes the printing operation at step S15 without waiting for the ink stirring operation to finish. This means that the printing operation is started while the ink is being stirred, i.e., the two operations are executed concurrently.

Step S16 checks if there is a next item (next page) to print. If not, the processing proceeds to step S17 where it ends the printing operation. If it is found that there is a next item (next page) to be printed, the processing returns to step S13.

At step S13 the processing checks the print data, one of the print signals received, to determine the kind of ink to be used in the printing operation. If, for example, an image including black letters is to be printed, it is decided based on the print data that the ink to be used in the printing operation includes at least the pigment K ink that does not easily blur. In that case, the printing apparatus waits for the ink stirring operation to finish before starting the printing operation, in which the image including black letters is printed using at least the pigment K ink. That is, the image including black letters can be printed using only the pigment K ink or a combination of the pigment K ink and at least one of the dye inks C, M, or Y. If an image of patterns covering an entire page is to be printed, it is decided according to the print data that the ink to be used in the printing operation does not include the pigment K ink. In that case, without waiting for the ink stirring operation to finish, the printing operation is started in which the image of patterns covering an entire print area on a page is printed using at least one of the dye inks C, M, or Y. This printing operation is performed concurrently with the ink stirring operation.

In this embodiment, the duration of the stirring operation executed prior to the printing operation is set to be longer when a pigment ink is included in the ink used for printing than when it is not. That is, when the printing operation using only a dye ink and not using a pigment ink at all is performed, the printing operation is started without waiting for the ink stirring operation to finish. This allows the printing operation to be immediately started without having to wait until the stirring operation on the pigment ink not used in the printing operation is finished. When the printing operation is not one that uses only dye inks, but one that uses at least a pigment ink, the printing operation is started only after the predetermined stirring operation has ended. With this procedure, the pigment ink to be supplied to the print head 6 for the printing operation can be stirred and made uniform in density, allowing a high quality image to be printed.

(Third Embodiment)

In step S2 of FIG. 7 and in step S13 of FIG. 11 in the first and second embodiment, the kind of ink to be used for the printing operation may be determined based on the kind of print medium. FIG. 12 shows a correspondence between the kind of print medium and the ink used in the printing operation.

Next, the basis for being able to use different inks based on the kind of print medium will be explained.

With dye ink, color is produced by the dye in the ink adhering to a print medium, so the effect the surface condition of the print medium has on the density or grayscale level of the image being printed is small. In the case of a pigment ink, on the other hand, since color is produced by the pigment in the ink coagulating and solidifying near the surface of the print medium, the influence that the surface condition of the print medium has on the image density is great. Further, pigment ink characteristically has large grains of pigment as a colorant and thus tends to roughen the printed surface of the medium after the ink is fixed. Therefore, pigment ink, depending on the kind of print medium, may cause remarkable variations in image density, degrading the quality of the printed image. For example, when a print medium with an inherently rough surface, such as plain paper and postcards, is printed on using a pigment ink, a good image is obtained. However, when a glossy print medium such as glossy paper, or a special print medium with a smooth surface, such as an OHF sheet, is printed on using a pigment ink, the glossiness inherent in these print mediums may be lost, making it impossible to produce the so-called picture quality. Taking into account the characteristics of pigment ink and dye ink, and in picking the ink to be used according to the kind of print medium as described above, is effective in enhancing the print quality.

In the example of FIG. 12, when an image is printed onto a glossy medium or an OHP sheet, only a dye ink is used, with no pigment ink used. In this case, depending on the image to be printed, at least one of the dye inks C, M, or Y is used. A black image can be produced by combining the dye inks C, M, and Y. When printing postcards and plain paper, a pigment ink and dye inks are used. In this case, the pigment ink and the dye inks can be used without any restriction, according to the image being printed.

(Other Embodiments)

In the above embodiments, the ink contained in the pigment ink tank has been described to be a pigment K ink, and the inks contained in the dye ink tanks have been described to be the three color dye CMY inks. However, there is no particular limitation on the number of ink tanks used and the colors of inks contained in the tanks, except that at least one pigment ink tank and at least one dye ink tank need to be used.

The step S3 of the first embodiment has been described to execute the ink stirring operation a predetermined number of times or for a predetermined duration. However, the duration of the stirring operation and the number of stirring motions may also be increased or decreased as required, according to the elapsed time from the last movement of the carriage, the elapsed time from the last ink stirring operation or the volume of data printed by the printing operation. For example, if the elapsed time from the last movement of the carriage or the elapsed time from the last ink stirring operation is less than a predetermined period of time, it may be decided that the need for the stirring operation is small and that the number of stirring motions and the duration of the stirring operation be reduced. If a decision is made that the stirring operation is not necessary, the stirring operation may not be executed.

The present invention can be applied to a wide variety of printing apparatus capable of printing on a print medium, using a pigment ink supplied from a pigment ink tank and dye inks supplied from dye ink tanks. That is, not only can this invention be applied to the serial scan type ink jet printing apparatus described above but also to a full line type ink jet printing apparatus using an elongate print head. Further, this invention is also applicable to various other types of apparatus, including but not limited to ink-painting type apparatus and stamping type apparatus.

The stirring operation mechanism to stir a pigment ink is not limited in construction to the aforementioned embodiments. The only requirement is the mechanism's capability to stir a liquid pigment ink to make its density uniform. The stir mechanism may, as in the first embodiment, be able to finish the stirring operation prior to the printing operation or, as in the second embodiment, to start the stirring operation prior to the printing operation. The function to determine the kind of ink to be used in the printing operation may be assigned to the CPU 103 of the printing apparatus or a part or all of that function may be given to the host device 400.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-314637, filed Dec. 10, 2008, which is hereby incorporated by reference herein in its entirety.

What is claimed is:

1. A printing apparatus comprising:

a print head having pigment ejection openings for ejecting a pigment ink and dye ejection openings for ejecting a dye ink;

a pigment ink tank configured to contain pigment ink to be supplied to the print head;

a stir unit configured to perform a stirring operation for stirring pigment ink in the pigment ink tank, wherein ink is not ejected during the stirring operation;

a determining unit configured to determine whether the print head ejects pigment ink in a printing operation based on image data to be printed; and a control unit responsive to the determination by the determining unit of whether the print head ejects pigment ink in the printing operation, the control unit being configured to cause the stir unit to perform the stirring operation before the printing operation when the print head ejects pigment ink in the printing operation, and being configured to cause the print head to perform the printing operation without the stirring operation when the print head does not eject pigment ink in the printing operation.

2. A printing apparatus according to claim 1, wherein, when the image data includes image data for printing black letters, the determining unit determines that the print head ejects pigment ink in the printing operation.

3. A printing apparatus according to claim 1, wherein, when the image data is image data for printing a pattern covering an entire print area, the determining unit determines that the print head does not eject pigment ink in the printing operation.

4. A printing apparatus according to claim 1, wherein the stir mechanism has a diaphragm or a screw mechanism to stir the pigment ink in the pigment ink tank.

5. A printing apparatus according to claim 1, further comprising a dye ink tank configured to contain dye ink, and a carriage configured to mount the print head thereon and to move the print head, the pigment ink tank and the dye ink tank being mounted on the carriage.

6. A printing apparatus according to claim 5, wherein the stir mechanism stirs pigment ink in the pigment ink tank by causing the carriage to move back and forth a predetermined number of times or for a predetermined period.

7. A printing apparatus according to claim 1, wherein the printing apparatus receives the image data from an external device.

* * * * *